United States Patent [19]

Knapp et al.

[11] 4,174,511

[45] Nov. 13, 1979

[54] BIMETAL DEVICE WITH AN ELECTRICAL HEATING ELEMENT

[75] Inventors: Heinrich Knapp, Leonberg; Franz-Ulrich Bosch, Stuttgart; Gunther Schnepf, Gerlingen, all of Fed. Rep. of Germany

[73] Assignee: Robert Bosch GmbH, Stuttgart, Fed. Rep. of Germany

[21] Appl. No.: 886,318

[22] Filed: Mar. 13, 1978

[30] Foreign Application Priority Data

Mar. 24, 1977 [DE] Fed. Rep. of Germany ..... 2712951

[51] Int. Cl.[2] ..... H01H 71/16

[52] U.S. Cl. ..... 337/107; 219/511; 219/512; 219/543; 337/102; 338/22 R

[58] Field of Search ..... 219/509, 510, 511, 512, 219/540, 543, 553; 337/102, 107, 386; 338/22 R, 22 SD, 308, 221

[56] References Cited

U.S. PATENT DOCUMENTS

| | | | |
|---|---|---|---|
| 2,518,941 | 8/1950 | Satchwell et al. | 337/107 |
| 2,905,790 | 9/1959 | Markham | 219/511 UX |
| 2,920,165 | 1/1960 | Ditman et al. | 337/107 |
| 2,993,976 | 7/1961 | Moore | 219/511 X |
| 3,072,773 | 1/1963 | Clapp | 219/512 X |
| 3,257,526 | 6/1966 | Ramsey et al. | 337/107 X |
| 3,274,359 | 9/1966 | Riebs | 337/107 |
| 3,434,089 | 3/1969 | Waselewski, Jr. et al. | 337/40 |
| 3,495,150 | 2/1970 | Enemark | 338/221 |
| 3,525,914 | 8/1970 | Vind | 337/107 X |

FOREIGN PATENT DOCUMENTS

| | | | |
|---|---|---|---|
| 284627 | 11/1965 | Australia | 337/107 |
| 494087 | 6/1953 | Canada | 337/107 |
| 741384 | 11/1955 | United Kingdom | 337/107 |
| 1077283 | 7/1967 | United Kingdom | 337/107 |

*Primary Examiner*—Volodymyr Y. Mayewsky
*Attorney, Agent, or Firm*—Edwin E. Greigg

[57] ABSTRACT

A bimetal device with an electrical heating element which serves for temperature-dependent control is provided. The bimetal device has a thin insulating layer, on which is arranged at least one electrical resistance layer which serves as a heating element. The resistance layer can be placed on the base of the bimetal device by means of vapor depositing or by thick film technology. In this manner a plurality of resistance layers can be provided that are insulated from each other and of which one serves for continual heating. It can also be useful to provide only one resistance layer which is connected in series with a PTC resistor and holds the bimetal device at a certain temperature. The embodiment of the electrical heating element as a resistance layer makes possible a very rapid heating of the bimetal.

2 Claims, 4 Drawing Figures

BIMETAL DEVICE WITH AN ELECTRICAL HEATING ELEMENT

BACKGROUND OF THE INVENTION

The invention relates to a bimetal device which has an electrical heating element.

Bimetal devices with electrical heating elements are already known, in which, however, the wire resistors are enveloped in ceramic and take a long time to heat up despite high heating currents. Thus, the use of this known bimetal device with electrical heating elements used in a motor vehicle injection device for controlling the air-fuel mixture during starting and warm-up of the engine leads to an undesirable over-enriching of the mixture.

OBJECT AND SUMMARY OF THE INVENTION

It is a principal object of the invention to provide a bimetal device which can be rapidly heated while decreasing the necessary current for heating the required structural space and the cost of production.

This object is achieved by providing the bimetal device with at least one insulating layer on which at least one electrical resistance layer is arranged.

It is especially advantageous to vapor deposit the resistance layer onto the thin insulating layer or to place it by means of thick film technology. Also advantageous is the arrangement of a PTC resistor in series with a resistance layer, whereby the bimetal device can be held at a certain temperature.

BRIEF DESCRIPTION OF THE DRAWINGS

Exemplary embodiments of the invention are shown in simplified form in the drawings and are described in more detail in the following description. Shown are.

DESCRIPTION OF THE PREFERRED EMBODIMENTS

Figure 1:
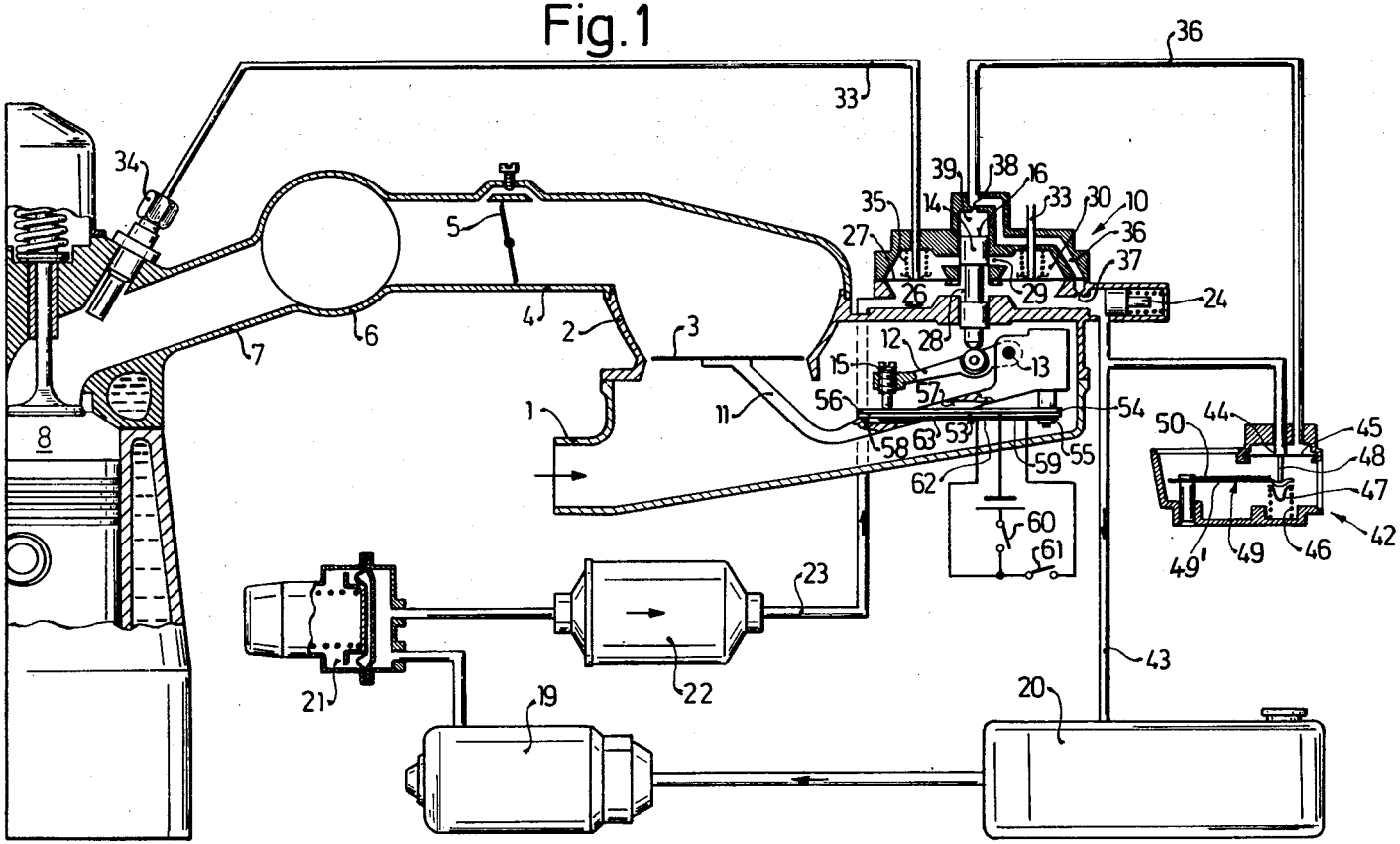
FIG. 1—A fuel injection system partly in cross section, for an internal combustion engine having a bimetal device with an electric heating element formed as a resistance path for controlling a fuel injection device.

According to the fuel injection device shown in FIG. 1, the combustion air flows in the direction shown by the arrow through an induction tube section 1 into a conical section 2, in which an air flow rate measuring element 3 is arranged, and then further through an induction tube section 4, which has an arbitrarily actuatable throttle plate 5 to a collecting induction tube 6 and from there through induction tube section 7 to one or more cylinders 8 of an internal combustion engine. The air flow rate measuring member 3 comprises a plate arranged across the direction of air flow. The plate moves in the conical section 2 of the induction tube according to a nearly linear function of the air flow rate through the induction tube, against a constant return force acting on the air flow rate measuring member and a constant air pressure prevailing in front of the air flow rate measuring member, with the pressure prevailing between the air flow rate measuring member 3 and the throttle plate 5 remaining constant. The air flow rate measuring member 3 controls a fuel metering and quantity distribution valve 10. A rocking lever 11, which is connected with the air flow rate measuring member 3 serves to transfer the adjusting movement of the air flow rate measuring member 3. The rocking lever 11 is mounted together with a correcting lever 12 at a pivot point 13. As the rocking lever 11 rotates it actuates the valve portion of the fuel metering and quantity distributing valve 10 which is formed as a distributing slide valve 14. The desired air-fuel mixture can be set by means of a mixture regulating screw 15. The frontal surface 16 of the distributing slide valve 14 that lies opposite the rocking lever 11 is acted upon by pressurized fluid, whose pressure against the frontal surface 16 produces the return force on the air flow rate measuring member 3.

The fuel supply produced by means of an electric fuel pump 19, which aspirates fuel from a fuel container 20 and pumps it through a fuel reservoir 21, a fuel filter 22 and a fuel supply line 23 to the fuel metering and quantity distribution valve 10. A system pressure regulator 24 maintains the system pressure constant in the fuel injection device.

The fuel supply line 23 leads through various branches to chambers 26 of the fuel metering and quantity distribution valve 10, so that one side of a diaphragm 27 is acted upon by the fuel pressure. The chambers 26 are also connected with an annular groove 28 of the distributing slide valve 14. Depending on the position of the distributing slide valve 14, the annular groove 28 opens a varying number of control slits 29, which each lead to a chamber 30, which are separated from the chamber 26 by the diaphragm 27. Proceeding from the chambers 30 the fuel passes through injection channels 33 to the individual injection valves 34, which are arranged in proximity to the engine cylinders 8 in the induction tube section 7. The diaphragm 27 serves as a movable element of a flat seat valve, which is held open by a spring 35 when the fuel injection device is not in operation. The chambers 26 and 30 form diaphragm boxes, which insure that the pressure drops at the metering valves 28, 29 remain primarily constant, independent of the overlap between the annular groove 28 and the control slits 29, that is, independent of the fuel flow rate to the injection valves 34. It is thus assured that the adjusting path of the distributing slide valve 14 and the metered fuel rates are proportional.

During a rotational movement of the rocking lever 11, the air flow rate measuring member 3 is moved into the conical section 2, so that the changing annular cross section between the air flow rate measuring member 3 and the cone is nearly proportional to the adjusting path of the air flow rate measuring member 3.

The pressurized fluid which produces the constant return force on the distributing slide valve 14 is fuel. For this reason a control pressure line 36 branches off from the fuel supply line 23, which control pressure line 36 is separated from the fuel supply line 23 by an uncoupling throttle 37. A pressure chamber 39 is connected with the control pressure line 36 by means of a damping throttle 38, into which pressure chamber 39 the frontal surface 16 of the distributing slide valve 14 projects.

A pressure control valve 42 is arranged in the control pressure line 36, through which the pressurized fluid can reach the fuel container 20, pressure relieved, through a return line 43. By means of the illustrated pressure control valve 42, the pressure of the pressurized fluid which produces the return force can be varied during the warm-up of the internal combustion engine according to a temperature and time function. The pressure control valve 42 is formed as a flat seat valve, having a rigid valve seat 44 and a diaphragm 45, which is loaded in the closing direction of the valve by a spring 46. The spring 46 acts on the diaphragm 45 by means of a spring plate 47 and a transfer pin 48. At temperatures beneath the engine operating temperature the force of spring 46 acts against a bimetal device 49. The bimetal device has a bimetallic base 49' on which an electrical resistance layer 50 is provided. The layer 50 is heated during engine starts, thus leading to a decrease of the force of the bimetal device on the spring 46.

A bimetal device 53 having a bimetallic base 53' serves for controlling a cold start fuel quantity at starting temperatures lower than approximately +20° C. The stationary end 54 of the bimetal device 53 is connected with the rocking lever 11 of the air flow rate measuring member 3 by means of a screw connection 55, and the free end 56 of the bimetal device 53 projects through an opening 57 in the rocking lever 11 and acts on the correcting lever 12 by means of the mixture regulating screw 15, by means of which the distributing slide valve 14 of the fuel metering and quantity distributing valve 10 can be actuated. The bimetal device 53 thus moves the correcting lever 12 in dependence on the starting temperature, and thereby moves the distributing slide valve 14 relative to the rocking lever 11 of the air flow rate measuring member 3. At temperatures above +20° C. the bimetal device 53 has bent so far away from the distributing slide valve 14 that it comes to rest against a shoulder 58 of the opening 57 of the rocking lever 11.

In order to achieve a decrease of the starting fuel quantity during engine starting, an electrical starting heating element 59 (FIG. 3) is provided on the base 53' of the bimetal device 53 in the form of an electrical resistance layer or path, whose electric circuit is closed by the ignition switch 60 and the starting switch 61. The heat generated in the electrical resistance layer 59 leads to bending of the bimetal device 53 in the direction of a decrease of the fuel rate controlled by the distributing slide valve 14. On the base 53' of the bimetal device 53 next to the resistance layer that serves as an electrical starting heating element 59, an additional electrical resistance layer, insulated from the first, is arranged as a heat retaining element 62, whose electrical circuit is closed by the ignition switch 60 and which serves to hold the bimetal device 53 against the shoulder 58 of the opening 57 of the rocking lever 11 upon conclusion of the starting process, i.e., when the starting heating element 59 is turned off. The electrical resistance layer formed as a heat retaining element 62 is designed so that it takes longer to get warm than does the resistance layer formed as a starting heating element 59. The resistance layers 59 and 62 are insulated by a thin insulating layer, preferably by a temperature-stable layer of lacquer (e.g. ofpolyimide-resin, bezonphenones-resin etc.) or layer of polymeric (e.g. ofpolytetrafluorethylene, polyarylsulfides etc.), from the base 53' of the bimetal device 53. The resistance layers 59, 62 can be vapor deposited on the lacquer layer 63, or placed by thick film technology. The entire arrangement can then be protected by a protecting lacquer. The resistance layers 59, 62 can penetrate the lacquer layer 63 on one end and be connected to the base 53' of the bimetal device 53 that is connected to ground.

Figure 2:
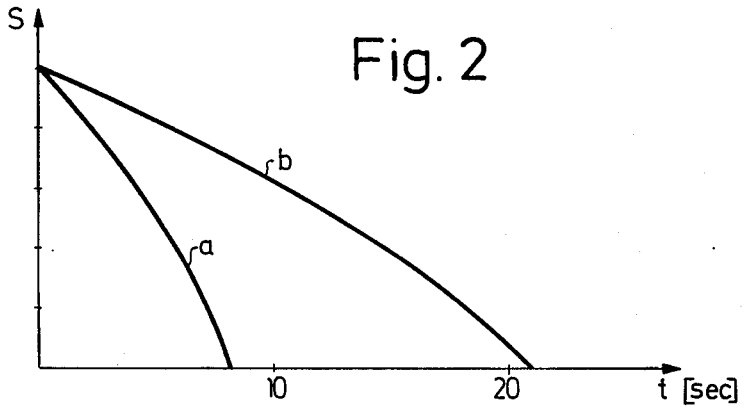
FIG. 2—A diagram showing the deformation of the bimetal device as a function of the heating time.

FIG. 2 is a diagram showing the deformation s of the bimetal device 53 at a certain original temperature in dependence on the heating time t. The curve b shows the curve in a known bimetal device with an electrical heating element, which is produced as a wire resistor on a ceramic core, while the curve a shows the substantially more rapid heating and thereby substantially more rapid change of the bimetal device bending with a bimetal device having a resistance layer arranged according to the invention.

Figure 3:
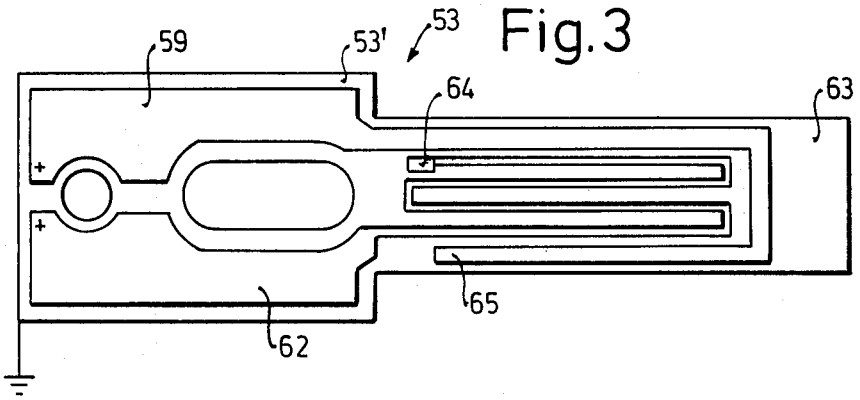
FIG. 3—A bimetal device with two resistance layers.

FIG. 3 illustrates the bimetal device 53 to a larger scale with a first resistance layer 59 and a second resistance layer 62, which can be arranged in a meandering fashion. The resistance layers 59 and 62 are electrically insulated from the base 53' of the bimetal device 53 by the lacquer layer 63, but penetrate with their ends 64, 65, respectively, through the insulating layer and are connected with the base 53' of the bimetal device 53, which is grounded.

Figure 4:
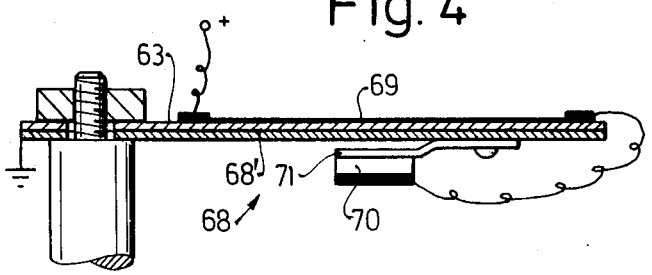
FIG. 4—A bimetal device with a resistance layer arranged in series with a PTC resistor.

In the further exemplary embodiment of the invention shown in FIG. 4, a bimetal device 68 having a bimetallic base 68' is also provided with a lacquer layer 63, on which is arranged, however, only one resistance layer 69, which is connected electrically in series with a PTC resistor 70, so that the bimetal device 68 is held automatically at a certain temperature once this desired temperature is reached. The PTC resistor 70 is located on a metal attachment 71, which produces a sufficiently good warming conductor to the bimetal device 68 and holds the bimetal device 68 away from the PTC resistor 70. By means of the series connection of the resistance layer 69 and the PTC resistor 70, the resistance layer and the additional connection therefor, of the embodiment illustrated in FIGS. 1 and 3, can be done without.

Both in the bimetal device 49 with the resistance layer 50 that is insulated by an insulating layer 63, and in the bimetal device 68 with the resistance layer 69 and the PTC resistor 70, the electrical connection can take place as shown in the electrical circuit in FIG. 1 for the resistance layers 59, 62.

What is claimed is:

1. A bimetal device for use in a motor vehicle injection fuel device for controlling the air-fuel mixture during starting and warm-up of the engine comprising, in combination, a bimetallic base, a thin insulating layer on said bimetallic base, at least one electrical resistance heating element on said insulating layer in heat transfer relationship with said bimetallic base, a PTC resistor supported on said bimetallic base out of heat transfer relationship therewith and serially connected with said at least one resistance heating element and means for connecting said serially connected PTC resistor and said resistance heating element with an associated source of electrical power whereby said bimetal device can be held at a certain temperature.

2. A bimetal device in accordance with claim 1, including a metal attachment connected with said bimetallic base and wherein said PTC resistor is disposed on said metal attachment.

* * * * *